US009951283B2

(12) United States Patent
Choi et al.

(10) Patent No.: US 9,951,283 B2
(45) Date of Patent: Apr. 24, 2018

(54) PETROLEUM UPGRADING AND DESULFURIZING PROCESS

(71) Applicant: Saudi Arabian Oil Company, Dhahran (SA)

(72) Inventors: Ki-Hyouk Choi, Dhahran (SA); Mohammad F. Aljishi, Qatif (SA)

(73) Assignee: SAUDI ARABIAN OIL COMPANY (SA)

( * ) Notice: Subject to any disclaimer, the term of this patent is extended or adjusted under 35 U.S.C. 154(b) by 366 days.

(21) Appl. No.: 13/952,042

(22) Filed: Jul. 26, 2013

(65) Prior Publication Data

US 2013/0313162 A1 Nov. 28, 2013

Related U.S. Application Data

(63) Continuation of application No. 13/009,062, filed on Jan. 19, 2011, now Pat. No. 8,535,518.

(51) Int. Cl.
*C10G 55/04* (2006.01)
*C10G 47/00* (2006.01)
(Continued)

(52) U.S. Cl.
CPC ..... *C10G 55/04* (2013.01); *C10G 21/08* (2013.01); *C10G 25/00* (2013.01); *C10G 45/02* (2013.01);
(Continued)

(58) Field of Classification Search
CPC ..... C10G 21/08; C10G 2300/1033; C10G 2300/202; C10G 2300/205;
(Continued)

(56) References Cited

U.S. PATENT DOCUMENTS 2,880,171 A 3/1959 Flinn et al.
2,944,012 A 7/1960 Thompson
(Continued)

FOREIGN PATENT DOCUMENTS

EP 0199555 A2 10/1986
EP 0341893 11/1989
(Continued)

OTHER PUBLICATIONS

Johnson, B.B., Effect of pH, Temperature, and Concentration on the Adsorption of Cadmium on Geothite, Environ. Sci. Technol., 1990, vol. 24, p. 112-118, temperature is a result determinate variable for adsorption. (Johnson, p. 116-117).*
(Continued)

*Primary Examiner* — Renee Robinson
*Assistant Examiner* — Derek N Mueller
(74) *Attorney, Agent, or Firm* — Bracewell LLP; Constance Gall Rhebergen

(57) ABSTRACT

A petroleum feedstock upgrading method is provided. The method includes supplying a mixed stream that includes hydrocarbon feedstock and water to a hydrothermal reactor where the mixed stream is maintained at a temperature and pressure greater than the critical temperatures and pressure of water in the absence of catalyst for a residence time sufficient to convert the mixed stream into a modified stream having an increased concentration of lighter hydrocarbons and/or concentration of sulfur containing compounds. The modified stream is then supplied to an adsorptive reaction stage charged with a solid adsorbent operable to remove at least a portion of the sulfur present to produce a trimmed stream. The trimmed stream is then separated into a gas and a liquid streams, and the liquid stream is separated into a water stream and an upgraded hydrocarbon product stream.

14 Claims, 3 Drawing Sheets

(51) Int. Cl.

| | |
|---|---|
| ***C10G 25/00*** | (2006.01) |
| ***C10G 45/02*** | (2006.01) |
| ***C10G 47/32*** | (2006.01) |
| ***C10G 21/08*** | (2006.01) |

(52) U.S. Cl.

CPC ..... *C10G 47/00* (2013.01); *C10G 47/32* (2013.01); *C10G 2300/1033* (2013.01); *C10G 2300/202* (2013.01); *C10G 2300/205* (2013.01); *C10G 2300/308* (2013.01); *C10G 2300/4006* (2013.01); *C10G 2300/4012* (2013.01); *C10G 2300/805* (2013.01); *C10G 2400/04* (2013.01)

(58) Field of Classification Search

CPC ..... C10G 2300/308; C10G 2300/4006; C10G 2300/4012; C10G 2300/805; C10G 2400/04; C10G 25/00; C10G 45/02; C10G 47/00; C10G 47/32

See application file for complete search history.

(56) References Cited

U.S. PATENT DOCUMENTS

| | | | |
|---|---|---|---|
| 2,967,204 | A | 1/1961 | Beuther et al. |
| 3,116,234 | A | 12/1963 | Douwes et al. |
| 3,501,396 | A | 3/1970 | Gatsis |
| 3,576,596 | A | 4/1971 | Krane et al. |
| 3,586,621 | A | 6/1971 | Pitchford et al. |
| 3,654,139 | A | 4/1972 | Winsor et al. |
| 3,733,259 | A | 5/1973 | Wilson et al. |
| 3,830,752 | A | 8/1974 | Mickelson |
| 3,842,014 | A | 10/1974 | Friend et al. |
| 3,864,451 | A | 2/1975 | Lee et al. |
| 3,948,754 | A | 4/1976 | McCollum et al. |
| 3,948,755 | A | 4/1976 | McCollum et al. |
| 3,960,706 | A | 6/1976 | McCollum et al. |
| 3,960,708 | A | 6/1976 | McCollum et al. |
| 3,988,238 | A | 10/1976 | McCollum et al. |
| 3,989,618 | A | 11/1976 | McCollum et al. |
| 4,005,005 | A | 1/1977 | McCollum et al. |
| 4,082,695 | A | 4/1978 | Rosinski et al. |
| 4,151,068 | A | 4/1979 | McCollum et al. |
| 4,203,829 | A | 5/1980 | Bertolacini |
| 4,210,628 | A | 7/1980 | Ninomiya et al. |
| 4,325,926 | A | 4/1982 | Blanton, Jr. |
| 4,464,252 | A | 8/1984 | Eberly, Jr. |
| 4,483,761 | A | 11/1984 | Paspek, Jr. |
| 4,485,007 | A | 11/1984 | Tam et al. |
| 4,530,755 | A | 7/1985 | Ritchie et al. |
| 4,544,481 | A | 10/1985 | Seiver et al. |
| 4,594,141 | A | 6/1986 | Paspek, Jr. et al. |
| 4,719,000 | A | 1/1988 | Beckberger |
| 4,743,357 | A | 5/1988 | Patel et al. |
| 4,762,814 | A | 8/1988 | Parrott et al. |
| 4,813,370 | A | 3/1989 | Capamaggio |
| 4,818,370 | A | 4/1989 | Gregoli et al. |
| 4,840,725 | A | 6/1989 | Paspek |
| 4,908,122 | A | 3/1990 | Frame et al. |
| 5,087,350 | A | 2/1992 | Paris-Marcano |
| 5,096,567 | A | 3/1992 | Paspek, Jr. et al. |
| 5,167,797 | A | 12/1992 | Ou |
| 5,278,138 | A | 1/1994 | Ott et al. |
| 5,316,659 | A | 5/1994 | Brons et al. |
| 5,411,658 | A | 5/1995 | Chawla et al. |
| 5,421,854 | A | 6/1995 | Kodas et al. |
| 5,439,502 | A | 8/1995 | Kodas et al. |
| 5,466,363 | A | 11/1995 | Audeh et al. |
| 5,496,464 | A | 3/1996 | Piskorz et al. |
| 5,529,968 | A | 6/1996 | Sudhakar et al. |
| 5,538,930 | A | 7/1996 | Sudhakar et al. |
| 5,558,783 | A | 9/1996 | McGuinness |
| 5,597,476 | A | 1/1997 | Hearn et al. |
| 5,611,915 | A | 3/1997 | Siskin et al. |
| 5,616,165 | A | 4/1997 | Glicksman et al. |
| 5,676,822 | A | 10/1997 | Sudhakar |
| 5,695,632 | A | 12/1997 | Brons et al. |
| 5,837,640 | A | 11/1998 | Sudhakar et al. |
| 5,851,381 | A | 12/1998 | Tanaka et al. |
| 5,861,136 | A | 1/1999 | Glicksman et al. |
| 5,906,730 | A | 5/1999 | Hatanaka et al. |
| 5,928,497 | A | 7/1999 | Iaccino |
| 5,958,224 | A | 9/1999 | Ho et al. |
| 6,063,265 | A | 5/2000 | Chiyoda et al. |
| 6,096,194 | A | 8/2000 | Tsybulevskiy et al. |
| 6,103,393 | A | 8/2000 | Kodas et al. |
| 6,120,679 | A | 9/2000 | Hatanaka et al. |
| 6,153,123 | A | 11/2000 | Hampden-Smith et al. |
| 6,159,267 | A | 12/2000 | Hampden-Smith et al. |
| 6,197,718 | B1 | 3/2001 | Brignac et al. |
| 6,228,254 | B1 | 5/2001 | Jossens et al. |
| 6,248,230 | B1 | 6/2001 | Min et al. |
| 6,277,271 | B1 | 8/2001 | Kocal |
| 6,303,020 | B1 | 10/2001 | Podrebarac et al. |
| 6,316,100 | B1 | 11/2001 | Kodas et al. |
| 6,325,921 | B1 | 12/2001 | Andersen |
| 6,334,948 | B1 | 1/2002 | Didillon et al. |
| 6,488,840 | B1 | 12/2002 | Greaney et al. |
| 6,500,219 | B1 | 12/2002 | Gunnerman |
| 6,551,501 | B1 | 4/2003 | Whitehurst |
| 6,579,444 | B2 | 6/2003 | Feimer et al. |
| 6,596,157 | B2 | 7/2003 | Gupta et al. |
| 6,610,197 | B2 | 8/2003 | Stuntz et al. |
| 6,623,627 | B1 | 9/2003 | Zhou |
| 6,685,762 | B1 | 2/2004 | Brewster et al. |
| 6,689,186 | B1 | 2/2004 | Hampden-Smith et al. |
| 6,699,304 | B1 | 3/2004 | Hampden-Smith et al. |
| 6,780,350 | B1 | 8/2004 | Kodas et al. |
| 6,827,845 | B2 | 12/2004 | Gong et al. |
| 6,881,325 | B2 | 4/2005 | Morris et al. |
| 7,144,498 | B2 | 12/2006 | McCall et al. |
| 7,264,710 | B2 | 9/2007 | Hokari et al. |
| 7,435,330 | B2 | 10/2008 | Hokari et al. |
| 7,731,837 | B2 | 6/2010 | Song et al. |
| 7,780,847 | B2 | 8/2010 | Choi |
| 7,842,181 | B2 | 11/2010 | Choi |
| 8,535,518 | B2 | 9/2013 | Choi et al. |
| 2003/0062163 | A1 | 4/2003 | Moulton et al. |
| 2003/0217952 | A1 | 11/2003 | Brignac et al. |
| 2004/0007506 | A1 | 1/2004 | Song et al. |
| 2004/0024072 | A1 | 2/2004 | Lin et al. |
| 2004/0118748 | A1 | 6/2004 | Lesemann et al. |
| 2004/0178123 | A1 | 9/2004 | Podrebarac |
| 2004/0188327 | A1 | 9/2004 | Groten |
| 2005/0040078 | A1 | 2/2005 | Zinnen et al. |
| 2005/0067323 | A1 | 3/2005 | Balko |
| 2005/0072137 | A1 | 4/2005 | Hokari et al. |
| 2005/0075528 | A1 | 4/2005 | Burkhardt et al. |
| 2005/0098478 | A1 | 5/2005 | Gupta et al. |
| 2005/0167333 | A1 | 8/2005 | McCall et al. |
| 2005/0173297 | A1 | 8/2005 | Toida |
| 2005/0252831 | A1 | 11/2005 | Dysard et al. |
| 2005/0284794 | A1 | 12/2005 | Davis et al. |
| 2006/0011511 | A1 | 1/2006 | Hokari et al. |
| 2006/0043001 | A1 | 3/2006 | Weston et al. |
| 2006/0154814 | A1 | 7/2006 | Zanibelli et al. |
| 2006/0163117 | A1 | 7/2006 | Hong |
| 2007/0111319 | A1 | 5/2007 | Bastide et al. |
| 2007/0234640 | A1 | 10/2007 | Jia et al. |
| 2008/0099373 | A1 | 5/2008 | Hokari et al. |
| 2008/0099374 | A1 | 5/2008 | He et al. |
| 2008/0099375 | A1 | 5/2008 | Landau et al. |
| 2008/0099376 | A1 | 5/2008 | He et al. |
| 2008/0099377 | A1 | 5/2008 | He et al. |
| 2008/0099378 | A1 | 5/2008 | He et al. |
| 2009/0032436 | A1 | 2/2009 | Takahashi et al. |
| 2009/0139715 | A1* | 6/2009 | Choi ..... C10G 9/00 166/272.1 |
| 2009/0145807 | A1 | 6/2009 | Choi et al. |
| 2009/0145808 | A1 | 6/2009 | Choi et al. |
| 2009/0148374 | A1 | 6/2009 | Choi |
| 2009/0166262 | A1 | 7/2009 | He et al. |

(56) References Cited

U.S. PATENT DOCUMENTS

| | | | |
|---|---|---|---|
| 2009/0230026 | A1 | 9/2009 | Choi et al. |
| 2010/0314583 | A1 | 12/2010 | Banerjee |
| 2011/0024330 | A1 | 2/2011 | Choi |

FOREIGN PATENT DOCUMENTS

| | | | |
|---|---|---|---|
| EP | 1454976 | | 9/2004 |
| EP | 1537912 | A1 | 6/2005 |
| EP | 1577007 | | 9/2005 |
| EP | 1923452 | | 5/2008 |
| FR | 2913235 | | 9/2008 |
| GB | 1098698 | | 1/1968 |
| JP | 07265689 | | 10/1995 |
| JP | 2000282063 | | 10/2000 |
| JP | 2001019984 | | 1/2001 |
| JP | 2001192676 | | 7/2001 |
| JP | 2003049180 | | 2/2003 |
| JP | 2003277770 | | 10/2003 |
| JP | 2005015533 | | 1/2005 |
| WO | 9600269 | | 1/1996 |
| WO | 9967345 | | 12/1999 |
| WO | 0179391 | | 10/2001 |
| WO | 02053684 | | 7/2002 |
| WO | 2005005582 | | 1/2005 |
| WO | 2007015391 | | 2/2007 |
| WO | 2009070561 | | 6/2009 |

OTHER PUBLICATIONS

Uematsu et al., "New Application of spray reaction technique to the preparation of supported gold catalysts for environmental catalysis", Journal of Molecular Catalysis A: Chemical 182-183, pp. 209-214—(2002).

Yazu et al., "Oxidative Desulfurization of Diesel Oil with Hydrogen Peroxide in the Presence of Acid Catalyst in Diesel Oil/Acetic Acid Biphasic System", Chemistry Letters, vol. 33, No. 10 (2004), pp. 1306-1307.

Yazu et al., "Immobilized Tungstophosphoric Acid-catalyzed Oxidative Desulfurization of Diesel Oil with Hydrogen Peroxide", Journal of Japan Petroleum Institute, vol. 46, No. 6 (2003), pp. 379-382.

Zhou et al., "Deep Desulfurization of Diesel Fuels by Selective Adsorption with Activated Carbons", Prepr. Pap.-Am. Chem. Soc., Div. Pet, Chem, 2004, 49(3), pp. 329-332.

Adschiri et al., "Catalytic Hydrodesulfurization of Dibenzothiophene through Partial Oxidation and Water-Gas Shift Reaction in Supercritical Water", published in Ind. Eng. Chem. Res., vol. 37, pp. 2634-2638, (1998).

Adschiri et al., "Hydrogenation through Partial Oxidation of Hydrocarbon in Supercritical Water", published in Int. J. of the Soc. of Mat. Eng. for Resources, vol. 7, No. 2, pp. 273-281, (1999).

Amemiya et al., "Catalyst Deactivation in Distillate Hydrotreating (Part 2) Raman Analysis of Carbon Deposited on Hydrotreating Catalyst for Vacuum Gas Oil", Journal of the Japan Petroleum Institute (2003), pp. 99-104, vol. 46, No. 2.

Amestica and Wolf, "Catalytic Liquefaction of Coal With Supercritical Water/CO/Solvent Media", XP-002663069, Fuel, Sep. 30, 1986, pp. 1226-1332, vol. 65, Butterworth & Co. (1986).

Chica et al., "Catalytic oxidative desulfurization (ODS) of diesel fuel on a continuous fixed-bed reactor", Journal of Catalysis, vol. 242, (2006), pp. 299-308.

Choi et al., "Facile ultra-deep desulfurization of gas oil through two-stage or layer catalyst bed", Catalysis Today (2003), vol. 86, pp. 277-286.

Choi et al., Impact of removal extent of nitrogen species in gas oil on its HDS performance: an efficient approach to its ultra deep desulfurization:, Applied Catalysis B: Environmental (2004), vol. 50, pp. 9-16.

Choi et al., "Preparation and Characterization on nano-sized CoMo/A12o3 catalyst for hydrodesulfurization", Applied Catalysis A: General 260 (2004) 229-236.

Choi et al., "Preparation of CO2 Absorbent by Spray Pyrolysis", Chemistry Letters, vol. 32, No. 10 (2003), pp. 924-925.

Choi et al., "Removal of Sulfur Compounds from Petroleum Stream", U.S. Appl. No. 12/825,842, filed Jun. 29, 2010.

EP Examiners Report issued in EP Patent Application No. 08857250.8, dated Jun. 28, 2011 (13 pages).

EP Examiners Report issued in EP Patent Application No. 08858377.8, dated Oct. 4, 2011 (6 pages).

Farag et al., "Carbon versus alumina as a support for Co-Mo catalysts reactivity towards HDS of dibenzothiophenes and diesel fuel", Catalysis Today 50 (1999) 9-17.

Filippis et al., "Oxidation Desulfurization: Oxidation Reactivity of Sulfur Compounds in Different Organic Matrixes", Energy & Fuels, vol. 17, No. 6 (2003), pp. 1452-1455.

Furimsky et al., "Deactivation of hydroprocessing catalyst", Catalysis Today (1999), pp. 381-495, vol. 52.

Gao et al., "Adsorption and reduction of NO2 over activated carbon at low temperature", Fuel Processing Technology 92, 2011, pp. 139-146, Elsevier B.V.

Gary, "Petroleum Refining Technology and Economics", 5th ed., CRC Press, pp. 463, (2007).

Hernandez et al., "Desulfurization of Transportation Fuels by Adsorption", Catalysis Reviews (2004), pp. 111-150, vol. 46, No. 2.

Kishita et al., "Upgrading of Bitumen by Hydrothermal Visbreaking in Supercritical Water with Alkai", Journal of the Japan Petroleum Institute, 2003, 215-221, 46(4).

Kouzu et al., "Catalytic potential of carbon-supported Ni—Mo-sulfide for ultra-deep hydrodesulfurization of diesel fuel", Applied Catalysis A: General 265 (2004) 61-67.

McCall, Technology Status Report—Coal Liquefaction, Cleaner Coal Technology Programme, XP-002663181, Department of Trade of Industry of the United Kingdom, Oct. 31, 1999, pp. 1-14, Retrieved from Internet (see attached PCT Search Report dated Nov. 23, 2011).

Messing et al., "Ceramic Powder Synthesis by Spray Pyrolysis", Journal of the American Ceramic Society, vol. 76, No. 11, pp. 2707-2726 (1993).

Min, "A Unique Way to Make Ultra Low Sulfur Diesel", Korean Journal of Chemical Engineering, vol. 19, No. 4, (2002) pp. 601-606, XP008084152.

Mizushima et al., "Preparation of Silica-supported Nickel Catalyst by Fume Pyrolysis: Effects of Preparation Conditions of Precursory Solution on Porosity and Nickel Dispersion", Journal of the Japan Petroleum Institute, vol. 48, No. 2, pp. 90-96(2005).

Mochida et al., "Adsorption and Adsorbed Species of SO2 during its Oxidative Removal over Pitch-Based Activated Carbon Fibers", Energy & Fuels, vol. 13, No. 2, 1999, pp. 369-373.

Mochida et al., "Kinetic study of the continuous removal of Sox on polyacrylonitrile-based activated carbon fibers", Fuel, vol. 76, No. 6 (1997), pp. 533-536.

Mochida et al., "Removal of Sox and Nox over activated carbon fibers", Carbon, vol. 38 (2000), pp. 227-239.

Murata et al., "A Novel Oxidative Desulfurization System for Diesel Fuels with Molecular Oxygen in the Presence of Cobalt Catalysts and Aldehydes", Energy & Fuels, vol. 18, No. 1 (2004), pp. 116-121.

Okamoto et al., "A study on the preparation of supported metal oxide catalysts using JRC-reference catalysts. I Preparation of a molybdena-alumina catalyst. Part 1. Surface area of alumina", Applied Catalysis A: General 170 (1998), pp. 315-328.

Okuyama et al., "Preparation of nanoparticles via spray route", Chemical Engineering Science, vol. 58, pp. 537-547 (2003).

Old et al., "ConocoPhillips S ZorbTM Sulfur Removal Technology: A Proven Solution to the ULSG Challenge", ERTC 9th Annual Meeting, Prague, pp. 1-16, ERTC 9th Annual Meeting, Refining & Petrochemical, Apr. 27-29, 2005, Kuala Lumpur Malaysia.

Otsuki et al., "Oxidative Desulfurization of Light Gas Oil and Vacuum Gas oil by Oxidation and Solvent Extraction", Energy & Fuels, vol. 14, No. 6 (2000), pp. 1232-1239.

(56) References Cited

OTHER PUBLICATIONS

Parker et al., "Liquefaction of Black Thunder Coal with Counterflow Reactor Technology", XP-002663163, Ninth Pittsburgh Coal Conference, Oct. 31, 1992, pp. 1191-1195, Retrieved from Internet (see attached PCT Search Report dated Nov. 23, 2011).
Pawelec et al., "Carbon-supported tungsten and nickel catalysts for hydrodesulfurization and hydrogenation reactions", Applied Catalysis A: General 206 (2001) 295-307.
PCT International Search Report and Written Opinion dated Mar. 30, 2012, International Application No. PCT/US2012/021163, International Filing Date Jan. 13, 2012.
PCT International Search Report dated Nov. 21, 2011, International Application No. PCT/US2011/051192, International Filing Date: Sep. 12, 2011.
PCT International Search Report dated Nov. 23, 2011, International Application No. PCT/US2011/051183, International Filing Date: Sep. 12, 2011.
Pinero et al., "Temperature programmed desorption study on the mechanism of SO2 oxidation by activated carbon and activated carbon fibers", Carbon, vol. 39 (2001), pp. 231-242.
Robinson et al., "Thermochemistry of Coking in Hydroprocessing Units: Modeling Competitive Naphthalene Saturation and Condensation Reactions", XP-002663070, Apr. 26, 2006, Retrieved from Internet (see attached PCT Search Report dated Nov. 21, 2011).
Sampanthar et al., "A novel oxidative desulfurization process to remove.refractory sulfur compounds from diesel fuel", Applied Catalysis B: Environmental 63 (2006), pp. 85-93.
Sano et al., "Adsorptive removal of sulfur and nitrogen species from a straight run gas oil for its deep hydrodesulfurization", American Chemical Society, Fuel Chemistry Division Preprints (2003), vol. 48, 1, pp. 138-139.
Sano et al., "Adsorptive removal of sulfur and nitrogen species from a straight run gas oil over activated carbons for its deep hydrodesulfurization", Applied Catalysis B: Environmental (2004), vol. 49, pp. 219-225.
Sano et al., "Effects of nitrogen and refractory sulfur species removal on the deep HDS of gas oil", Applied Catalysis B: Environmental (2004), vol. 53, pp. 169-174.
Sano et al., "Selection and Further Activation of Activated Carbons for Removal of Nitrogen Species in Gas Oil as a Pre-Treatment for Deep Desulfurization" American Chemical Society, Fuel Chemistry Division Preprints (2003), vol. 48(2), pp. 658-659.
Sano et al., "Selection and Further Activation of Activated Carbons for Removal of Nitrogen Species in Gas Oil as a Pretreatment for its Deep Hydrodesulfurization", Energy & Fuels (2004) pp. 644-651, vol. 18.
Sano et al., "Two-step adsorption process for deep desulfurization of diesel oil", Fuel (2005), pp. 903-910, vol. 84, Elsevier Ltd.
Sato et al., "Upgrading of asphalt with and without partial oxidation in supercritical water", published in Science Direct, Fuel, vol. 82, pp. 1231-1239 (2003).
Shirahama et al., "Mechanistic study on adsorption and reduction of NO2 over activated carbon fibers", Carbon, vol. 40 (2002), pp. 2605-2611.
Skrabalak et al., "Porous MoS2 Synthesized by Ultrasonic Spray Pyrolysis", J. Am. Chem. Soc. 2005, 127, 9990-9991.
Te et al., "Oxidation reactivities of dibenzothiophenes in polyoxometalate/H202 and formic acid/H202 systems", Applied Catalysis A: General 219 (2001), pp. 267-280.

* cited by examiner

PETROLEUM UPGRADING AND DESULFURIZING PROCESS

CROSS-REFERENCE TO RELATED PATENT APPLICATIONS

This patent application is a continuing application of U.S. patent application Ser. No. 13/009,062, filed on Jan. 19, 2011. For purposes of United States patent practice, this application incorporates the contents of the prior Application by reference in its entirety.

FIELD OF INVENTION

This invention relates to a method and apparatus for upgrading a petroleum feedstock. More specifically, the present invention relates to a method and apparatus for upgrading a hydrocarbon feedstock with supercritical water.

BACKGROUND OF THE INVENTION

Petroleum is an indispensable source for energy and chemicals. At the same time, petroleum and petroleum based products are also a major source for air and water pollution. To address growing concerns with pollution caused by petroleum and petroleum based products, many countries have implemented strict regulations on petroleum products, particularly on petroleum refining operations and the allowable concentrations of specific pollutants in fuels, such as, sulfur content in gasoline fuels. For example, motor gasoline fuel is regulated in the United States to have a maximum total sulfur content of less than 15 ppm sulfur.

Due to its importance in our everyday lives, demand for petroleum is constantly increasing and regulations imposed on petroleum and petroleum based products are becoming stricter. Available petroleum sources currently being refined and used throughout the world, such as, crude oil and coal, contain much higher quantities of impurities (such as, elemental sulfur and/or compounds containing sulfur, nitrogen and metals). Additionally, current petroleum sources typically include large amounts of heavy hydrocarbon molecules, which must be converted to lighter hydrocarbon molecules through expensive processes like hydrocracking, for eventual use as a transportation fuel.

Current conventional techniques for petroleum upgrading include hydrogenative methods which require an external source of hydrogen in the presence of a catalyst, such as hydrotreating and hydrocracking. Thermal methods that may be performed in the absence of hydrogen are also known in the art, such as coking and visbreaking.

Conventional methods for petroleum upgrading, however, suffer from various limitations and drawbacks. For example, hydrogenative methods typically require large amounts of hydrogen gas to be supplied from an external source to attain desired levels of hydrocarbon upgrading and conversion. These methods can also suffer from premature or rapid deactivation of catalyst, as is typically the case during hydrotreatment of a heavy feedstock and/or hydrotreatment under harsh conditions, thus requiring regeneration of the catalyst and/or addition of new catalyst, which in turn can lead to process unit downtime and increase the costs associated with upgrading the hydrocarbon feedstock. Thermal methods frequently suffer from the production of large amounts of coke as a byproduct of the process and a limited ability to remove impurities, such as, sulfur, nitrogen and metals. This in turn results in the production of large amount of olefins and diolefins, which may require stabilization.

Additionally, thermal methods require specialized equipment suitable for severe conditions (high temperature and high pressure), require an external hydrogen source, and require the input of significant energy, thereby resulting in increased complexity and cost.

As noted above, the provision and use of an external hydrogen supply is both costly and dangerous. Alternative known methods for providing hydrogen include partial oxidation and production of hydrogen via a water-gas shift reaction. Partial oxidation converts hydrocarbons to carbon monoxide, carbon dioxide, hydrogen and water, as well as partially oxidized hydrocarbon molecules such as carboxylic acids; however, the partial oxidation process also removes a portion of valuable hydrocarbons present in the feedstock and can cause severe coking.

Thus, there exists a need to provide a process for the upgrading of hydrocarbon feedstocks that do not require the use an external hydrogen supply. Additionally, there exists a need to provide a process for the upgrading of hydrocarbon feedstocks at reduced operating conditions (i.e., at reduced temperature and pressure), and/or at increased rates. Methods described herein are suitable for the production of more valuable hydrocarbon products having one or more of a higher API gravity, higher middle distillate yields, decreased pour point, decreased viscosity, lower sulfur content, lower nitrogen content, and/or lower metal content via upgrading with supercritical water without requiring any use of a or the external supply of hydrogen.

SUMMARY

The current invention provides a method and apparatus for the upgrading of a hydrocarbon feedstock with supercritical water, wherein the upgrading method specifically includes an adsorptive reaction stage and excludes the use of an external supply of hydrogen.

In one aspect, a method of upgrading a hydrocarbon feedstock is providing. The method including the steps of supplying a mixed stream that includes the hydrocarbon feedstock and water to a hydrothermal reactor, wherein the mixed stream is maintained at a pressure between about 22.06 and 25 MPa and a temperature of between about 372° C. and about 425° C., and wherein the hydrothermal reactor does not include a catalyst. The mixed stream is maintained in the hydrothermal reactor at said pressure and temperature for a period of at least about 10 minutes to produce a first product stream, said first product stream having a higher concentration of light hydrocarbons than the hydrocarbon feedstock. The first product stream is supplied from the hydrothermal reactor to an adsorptive reaction stage to produce a trimmed stream and the trimmed stream is separated into a gas-phase stream and a liquid-phase stream. The liquid stream is then separated into a water stream and an upgraded hydrocarbon product stream.

In certain embodiments, the adsorptive reaction stage is charged with a solid adsorbent. In other embodiments, the solid adsorbent includes up to four active materials selected from the group consisting of elements from Group IB, Group IIB, Group IVB, Group VB, Group VIB, Group VIIB, and Group VIIIB of the periodic table. In certain embodiments, the solid adsorbent further includes a promoting material that is selected from up to four elements selected from the group consisting of elements from Group IA, Group IIA, Group IIIA and Group IVA of the periodic table. In certain embodiments, the solid adsorbent further includes a modifying material that is selected from up to four elements selected from the group consisting of elements from Group VIA and Group VIIA of the periodic table. In certain embodiments, the solid adsorbent includes a support material that is selected from up to four compounds selected from the group consisting of aluminum oxide, silicon oxide, titanium oxide, magnesium oxide, yttrium oxide, lanthanum oxide, cerium oxide, zirconium oxide and activated carbon.

In certain embodiments, the mixed stream is pre-heated to a temperature of at least 350° C. before being supplied to the hydrothermal reactor. In certain embodiments, the hydrocarbon feedstock is selected from whole range crude oil, topped crude oil, liquefied coal, a product stream from a petroleum refinery, a product stream from a steam cracker, or a liquid product recovered from oil sand, bitumen or asphaltene. In certain embodiments, the upgraded hydrocarbon produce stream has at least one of a higher API gravity, higher middle distillate yield, lower content of sulfur containing compounds, lower content of nitrogen compounds, or lower content of metal containing compounds.

In another aspect, a method of upgrading a hydrocarbon feedstock is provided. The method includes the steps of supplying a hydrocarbon feedstock stream to a pump to produce a pressurized hydrocarbon feedstock having a pressure of between about 24 MPa and about 26 MPa and supplying the pressurized hydrocarbon feedstock to a first pre-heater to produce a pre-heated pressurized hydrocarbon feedstock, wherein the pressurized hydrocarbon feedstock is pre-heated to a temperature of between about 200° C. and 250° C. The method also includes the step of supplying a water stream to a pump to produce a pressurized water stream having a pressure of between about 24 MPa and about 26 MPa; and thereafter supplying the pressurized water stream to a second pre-heater to produce a pre-heated pressurized water stream, wherein the pressurized water stream is preheated to a temperature of between about 400° C. and about 550° C. The pre-heated pressurized hydrocarbon feedstock and pre-heated pressurized water stream are supplied to a mixing device to produce a pre-heated pressurized hydrocarbon feedstock. The method includes supplying the pre-heated pressurized hydrocarbon feedstock to a hydrothermal reactor, wherein the hydrothermal reactor is catalyst-free and is maintained at a temperature of between about 22.06 MPa and about 25 MPa and a temperature of between about 372° C. and about 425° C., wherein the hydrocarbon feedstock is maintained in the hydrothermal reactor for a residence time of between about 30 seconds and about 10 minutes to produce a first product stream, wherein the first product stream has a lower sulfur content and a higher content of light hydrocarbons than the hydrocarbon feedstock. The method further includes reducing the temperature and pressure of the first product stream to produce a product stream having a temperature of less than about 374° C. and a pressure of less than about 22.06 MPa. The product stream is then supplied to an adsorptive reaction stage charged with a solid adsorbent to produce a trimmed stream, wherein the trimmed stream has a lower sulfur content than the first product stream. The trimmed stream is separated into a gas-phase stream and a liquid-phase stream; and the liquid stream is separated into a water stream and an upgraded hydrocarbon product stream, wherein the upgraded hydrocarbon product stream has at least one of a higher API gravity, a higher middle distillate yield, or a lower sulfur content than the hydrocarbon feedstock.

In another embodiment, a method for upgrading a petroleum feedstock without supplying an external hydrogen gas supply is provided. The method includes the steps of supplying a petroleum feedstock and supplying a water stream to a mixer, wherein the step of supplying the petroleum feedstock includes pumping the petroleum feedstock to a pressure greater than 22.06 MPa and heating the petroleum feedstock to a temperature of up to about 250° C. to produce a pressurized and heated petroleum feedstock, and wherein the step of supplying the water stream to the hydrothermal reactor includes pumping the water stream to a pressure greater than 22.06 MPa and heating the water stream to a temperature of between about 250° C. and 650° C. to produce a pressurized and heated water feed. The heated and pressurized petroleum feedstock and the heated and pressurized water feed are combined in the mixer to produce a pressurized and heated combined stream. The pressurized and heated combined stream is supplied to a hydrothermal reactor that is maintained at a temperature of between about 380° C. and 550° C., wherein the pressurized and heated combined stream is maintained in a reaction zone of the hydrothermal reactor for a hydrothermal residence time of between about 10 seconds and 20 minutes, to produce a modified stream. The modified stream is supplied from the hydrothermal reactor to an adsorptive reaction stage, wherein the adsorptive reaction stage is maintained at a temperature of between about 50° C. and 350° C. and is charged with heterogeneous catalyst, wherein the heterogeneous catalyst is operable to adsorb at least one impurity from the modified stream selected from the group consisting of sulfur, nitrogen, or a metal, to produce a trimmed stream. The trimmed stream is cooled and depressurized to produce a gas stream and a liquid stream. The liquid stream is then separated to produce a water stream and an upgraded petroleum product stream.

In certain embodiments, the petroleum feedstock and the water feed are supplied to the hydrothermal reactor at a volumetric flow rate of petroleum feedstock to water of between about 1:10 and 10:1. In other embodiments, the volumetric flow rate of petroleum feedstock to water is between 1:5 and 5:1, alternatively between 1:2 and 2:1.

In certain embodiments, the heterogeneous catalyst includes a support material, an active material, a promoting material, and a modifying material. In certain embodiments, the active material includes between 1 and 4 elements selected from the group consisting of elements from Groups IVB, VB, VIIB, VIIB, VIIIB, IB, and IIB of the periodic table. In certain embodiments, the promoting material includes between 1 and 4 elements selected from the group consisting of elements from Groups IA, IIA, IIIA and VA of the periodic table. In certain embodiments, the modifying material includes between 1 and 4 elements selected from the group consisting of Groups VIA and VITA of the periodic table. In certain embodiments, the support material includes between 1 and 4 compounds selected from the group consisting of aluminum oxide, silicon oxide, titanium oxide, magnesium oxide, yttrium oxide, lanthanum oxide, cerium oxide, zirconium oxide, and activated carbon.

DETAILED DESCRIPTION OF THE INVENTION

Figure 1:
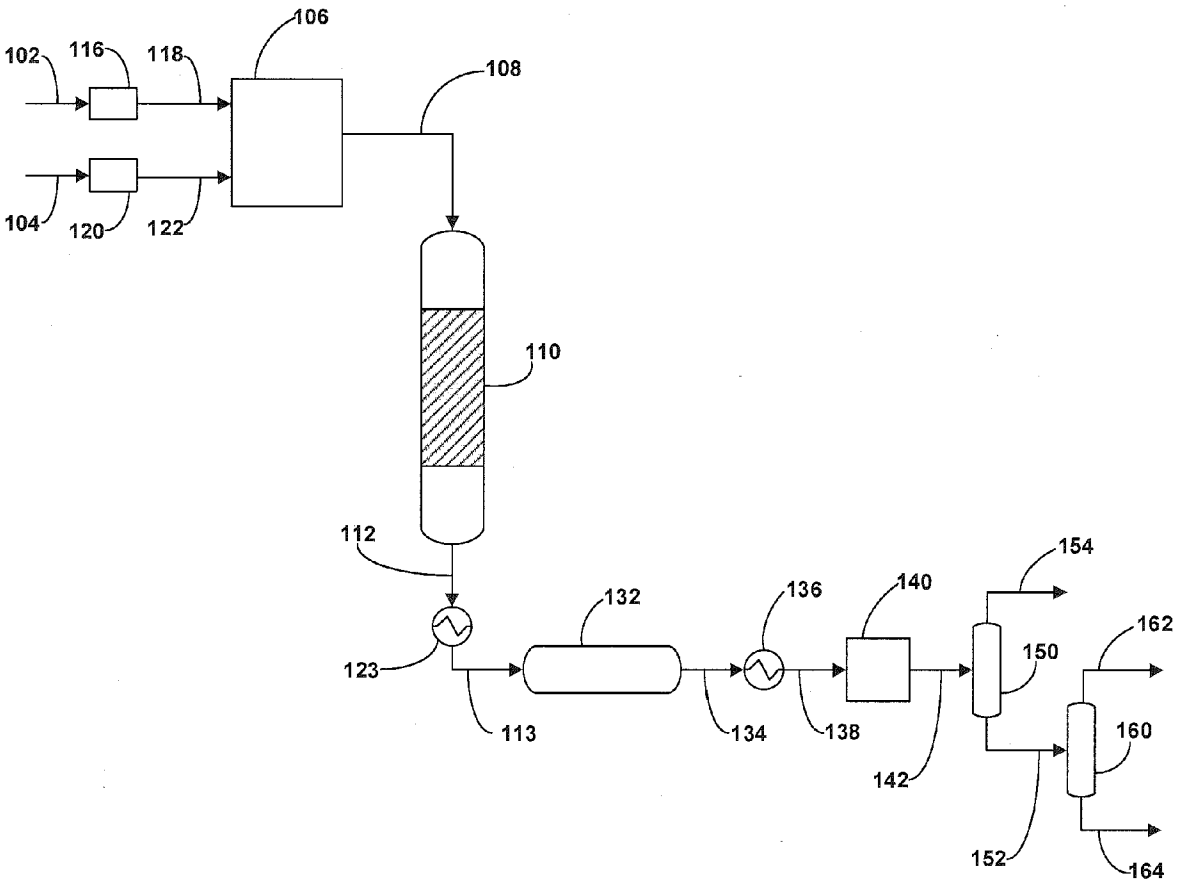
FIG. 1 provides a schematic diagram of one embodiment of the method of upgrading a hydrocarbon feedstock according to the present invention.

Although the following detailed description contains many specific details for purposes of illustration, it is understood that one of ordinary skill in the art will appreciate that many examples, variations and alterations to the following details are within the scope and spirit of the invention. Accordingly, the exemplary embodiments of the invention described herein and provided in the appended figures are set forth without any loss of generality, and without imposing limitations, relating to the claimed invention.

The present invention addresses problems associated with prior art methods upgrading a hydrocarbon feedstock. In one aspect, the present invention provides a method for upgrading a hydrocarbon containing petroleum feedstock. More specifically, in certain embodiments, the present invention provides a method for upgrading a petroleum feedstock utilizing supercritical water by a process which specifically excludes the use of an external supply of hydrogen gas, utilizing an adsorptive reaction stage, and results in an upgraded hydrocarbon product having reduced coke production, and/or significant removal of impurities, such as, elemental sulfur and/or compounds containing sulfur, nitrogen and metals. In general, the use of hydrogen gas is avoided for use with the hydrothermal process due to economic and safety concerns. In addition, the methods described herein result in various other improvements in the petroleum product, including higher API gravity, higher middle distillate yield (as compared with the middle distillate present in both the feedstock and comparable upgrading processes), and hydrogenation of unsaturated compounds present in the petroleum feedstock.

Hydrocracking is a well known chemical process wherein complex organic molecules or heavy hydrocarbons are broken down into simpler molecules (e.g., heavy hydrocarbons are broken down into lighter hydrocarbons, for example, methane, ethane, and propane, as well as higher value products, such as, naphtha-range hydrocarbons, and diesel-range hydrocarbons) by the breaking of carbon-carbon bonds. Typically, hydrocracking processes require the use of both very high temperatures and specialized catalysts. The hydrocracking a process can be assisted by use of elevated pressures, catalysts, and the supply of additional hydrogen gas, wherein, in addition to the reduction or conversion of heavy or complex hydrocarbons into lighter hydrocarbons, the additional hydrogen gas can also function to facilitate the removal of at least a portion of the sulfur and/or nitrogen present in a hydrocarbon containing petroleum feed. Hydrogen gas, however, can be expensive and can also be difficult and dangerous to handle at high temperatures and high pressures.

In one aspect, the present invention utilizes supercritical water as the reaction medium to upgrade petroleum, and specifically excludes the use of an external source of hydrogen gas. The critical point of water is achieved at reaction conditions of approximately 374° C. and 22.06 MPa. Above those conditions, the liquid and gas phase boundary of water disappears, and the fluid has characteristics of both fluid and gaseous substances. Supercritical water is able to dissolve organic materials like an organic solvent and has excellent diffusibility like a gas. Regulation of the temperature and pressure allows for continuous "tuning" of the properties of the supercritical water to be more liquid or more gas like. Supercritical water also has reduced density and lower polarity, as compared to liquid-phase sub-critical water, thereby greatly extending the possible range of chemistry which can be carried out in water. In certain embodiments, due to the variety of properties that are available by controlling the temperature and pressure, supercritical water can be used without the need for and in the absence of organic solvents.

Supercritical water has various unexpected properties, and, as it reaches supercritical boundaries and above, functions and behaves quite differently than subcritical water. For example, supercritical water has very high solubility toward organic compounds and has an infinite miscibility with gases. Also, near-critical water (i.e., water at a temperature and a pressure that are very near to, but do not exceed, the critical point of water) has very high dissociation constant. This means the water, at near-critical conditions, is very acidic. This high acidity of the water can be utilized as a catalyst for various reactions. Furthermore, radical species can be stabilized by supercritical water through the cage effect (i.e., a condition whereby one or more water molecules may surround a radical species, which then prevents the radical species from interacting). Stabilization of radical species is believed to help to prevent inter-radical condensation and thus, reduce the overall coke production in the current invention. For example, coke production can be the result of the inter-radical condensation, such as in polyethylene. In certain embodiments, supercritical water can generate hydrogen gas through a steam reforming reaction and water-gas shift reaction, which can then be made available for the upgrading and/or desulfurization of petroleum.

As used herein, the terms "upgrading" or "upgraded", with respect to petroleum or hydrocarbons refers to a petroleum or hydrocarbon product that is lighter (i.e., has fewer carbon atoms, such as methane, ethane, and propane, but also including naphtha-range and diesel-range produces), and/or has at least one of a higher API gravity, higher middle distillate yield, lower sulfur content, lower nitrogen content, or lower metal content, than does the original petroleum or hydrocarbon feedstock. In certain embodiments, the term "upgrading" or "upgraded" refers to a desulfurized product stream, relative to the feedstock. While the API gravity is typically correlated with the amount of middle distillate present (i.e., a higher API gravity usually corresponds to increased middle distillate content), the amount of impurities present in a petroleum of hydrocarbon stream (such as sulfur, nitrogen, and/or metal) does not necessarily correlate to the API gravity.

Thus, typically the API gravity increases as a result of cracking of larger hydrocarbon molecules to produce smaller hydrocarbon molecules, and/or the hydrogenation of unsaturated hydrocarbons to produce saturated hydrocarbons.

The petroleum feedstock can include any hydrocarbon crude that includes either impurities (such as, for example, elemental sulfur, compounds containing sulfur, nitrogen and metals, and combinations thereof) and/or heavy hydrocarbons. As used herein, heavy hydrocarbons refers to hydrocarbons having a boiling point of greater than about 360° C., and can include aromatic hydrocarbons, as well as alkanes and alkenes. Generally, the petroleum feedstock can be selected from whole range crude oil, topped crude oil, product streams from oil refineries including distillates, product streams from refinery steam cracking processes, liquefied coals, liquid products recovered from oil or tar sand, bitumen, oil shale, asphaltene, hydrocarbons that originate from biomass (such as for example, biodiesel), and the like, and mixtures thereof.

In the main hydrothermal reactor, through thermal reaction with the aid of supercritical water, the hydrocarbon feedstock undergoes multiple reactions, including cracking, isomerization, alkylation, hydrogenation, dehydrogenation, disproportionation, dimerization and oligomerization. In general, the rearrangement of hydrocarbons is a faster process than the removal of impurities, particularly at lower operating temperatures. At higher operating temperatures, the hydrothermal reactor generates larger amounts of cracked hydrocarbons, and thus produces a product stream having a higher API gravity. Additionally, at higher hydrothermal reactor operating temperatures, larger amounts of impurities are removed. The hydrothermal treatment with supercritical water is operable to generate hydrogen, carbon monoxide, carbon dioxide, hydrocarbons, and water through a steam reforming process for the upgrading process. Heteroatoms and metals, such as sulfur, nitrogen, vanadium, and nickel, can be transformed by the process and released.

Increasing the severity of the reaction conditions (i.e., increasing the temperature and/or pressure at which the reaction is performed) is typically used to increase the extent to which sulfur, nitrogen, and/or metals are removed. As noted before, however, severe operating conditions require huge energy consumption and require heavy-duty materials and designs for reactors, which in turn can substantially increase costs associated with the removal of impurities.

Referring to FIG. 1, a method for upgrading a petroleum feedstock is provided. Petroleum feedstock 102 is supplied to mixing device 106. Optionally, the line for supplying petroleum includes means for heating and pressurizing petroleum feedstock in line 102 to provide a heated and pressurized petroleum feedstock. A pump (not shown) can be provided for supplying, and optionally pressurizing, petroleum feedstock 102. In certain embodiments petroleum feedstock 102 can be preheated with preheater 116 to produce heated stream 118 having a temperature of up to about 250° C., alternatively between about 50° C. and 200° C., or alternatively between about 100° C. and 175° C. In certain other embodiments, petroleum feedstock 102 can be provided at a temperature as low as about 10° C. Preferably, the step of heating of the petroleum feedstock is limited, and the temperature to which the petroleum feedstock is heated is maintained as low as possible. The line for supplying petroleum feedstock 102 can include means to pressurize the petroleum feedstock to provide a pressurized petroleum feed at a pressure of greater than atmospheric pressure, preferably at least about 15 MPa, alternatively greater than about 20 MPa, or alternatively greater than about 22 MPa.

The method also includes a line for providing a water feed 104. The line for supplying water feed 104 can include means for heating and/or pressurizing the water feed, and in preferred embodiments, the water can be heated and pressurized to a temperature and pressure near or above the supercritical point of water (i.e., heated to a temperature near or greater than about 374° C. and pressurized to a pressure near or greater than about 22.06 MPa), to provide a heated and pressurized water feed. In certain embodiments, water feed 104 is pre-heated with pre-heater 120 to produce heated stream 122 having a temperature of at least about 400° C., alternatively at least about 425° C., alternatively at least about 450° C. In certain embodiments, water feed 104 can be pressurized to a pressure of between about 23 and 30 MPa, alternatively to a pressure of between about 24 and 26 MPa. In other embodiments, water feed 104 is heated to a temperature of greater than about 250° C., optionally between about 250° C. and 650° C., alternatively between about 300° C. and 600° C., or between about 400° C. and 550° C. In certain embodiments, water feed 104 is heated and pressurized to a temperature and pressure such that the water is in its supercritical state.

Petroleum feedstock 102 and water feed 104 can be heated using known means, including but not limited to, strip heaters, immersion heaters, tubular furnaces, heat exchangers, and like devices. Typically, petroleum feedstock 102 and water feed 104 are heated utilizing separate heating devices, although it is understood that a single heater can be employed to heat both the petroleum and water feed streams. In certain embodiments, as shown in FIG. 1, water feed 104 can be heated with heat exchanger 114. The volumetric ratio of petroleum feedstock and water can be between about 1:10 and 10:1, optionally between about 1:5 and 5:1, or optionally between about 1:2 and 2:1.

In certain embodiments, petroleum feedstock 102 and water feed 104 are both heated and pressurized prior to being supplied to mixing means 106. Alternatively, in other embodiments, one of the streams selected from petroleum feedstock 102 and water feed 104 can be heated and pressurized prior to being supplied to mixing means 106.

Petroleum feedstock 102 and water feed 104 can be supplied to mixing means 106 to produce a combined feed stream 108 that includes the petroleum and water feeds, wherein water feed is supplied at a temperature and pressure near or greater than the supercritical point of water. Petroleum feedstock 102 and water feed 104 can be combined by known means, such as for example, a valve, tee fitting or the like. Optionally, petroleum feedstock 102 and water feed 104 can be combined in a larger holding vessel that is maintained at a temperature and pressure above the supercritical point of water. Optionally, petroleum feedstock 102 and water feed 104 can be supplied to a larger vessel that includes mixing means, such as a mechanical stirrer, or the like. In certain preferred embodiments, petroleum feedstock 102 and water feed 104 are thoroughly mixed at the point at which they are combined. Optionally, mixing means 106 or holding vessel can include means for maintaining an elevated pressure and/or means for heating the combined petroleum and water stream.

Combined stream 108, which is optionally heated and pressurized, and which includes the petroleum feedstock and water supplied from lines 102 and 104 respectively, is supplied from mixing means 106 to hydrothermal reactor 110. Combined stream 108 can be supplied by any known means for supplying a feed steam that is operable to maintain a temperature and pressure above at least the supercritical point of water, such as for example, a tube or nozzle. Combined stream 108 can be supplied via insulated line. Preferably, the line supplying combined stream 108 is configured to operate at pressure greater than about 15 MPa, preferably greater than about 20 MPa, and even more preferably at greater than about 22.06 MPa. The residence time of the heated and pressurized combined stream 108 in the line supplying hydrothermal reactor 110 can be between about 0.1 seconds and 10 minutes, optionally between about 0.3 seconds and 5 minutes, or optionally between about 0.5 seconds and 1 minute. In preferred embodiments, the residence time of heated and pressurized combined stream 108 in the supply line is minimized to reduce heat loss.

Hydrothermal reactor 110 can be a known type of reactor, such as, a tubular type reactor, vessel type reactor, optionally equipped with stirrer, or the like, which is constructed from materials that are suitable for the high-temperature and high-pressure applications required in the present invention. Hydrothermal reactor 110 can be horizontal, vertical or a combined reactor having both horizontal and vertical reaction zones. In certain embodiments, hydrothermal reactor 110 does not include a solid catalyst. The temperature of hydrothermal reactor 110 is maintained at a temperature greater than about 374° C. In certain embodiments, the temperature of hydrothermal reactor 110 can be maintained between about 380 to 550° C., optionally between about 390 to 500° C., or optionally between about 400 to 450° C. Hydrothermal reactor 110 can include one or more heating devices, such as for example, a strip heater, immersion heater, tubular furnace, or the like, as known in the art. The residence time of heated and pressurized combined feed in the hydrothermal reactor 110 can be between about 1 second to 120 minutes, optionally between about 10 second to 60 minutes, or optionally between about 30 seconds to 20 minutes.

The reaction of supercritical water and the petroleum feedstock (i.e., supplying combined steam 108, which includes petroleum feedstock and water, to hydrothermal reactor 110) is operable to accomplish at least one of: cracking, isomerizing, alkylating, hydrogenating, dehydrogenating, disporportionating, dimerizing and/or oligomerizing, of hydrocarbons present in the petroleum feedstock by thermal reaction. Without being bound by theory, it is believed that the supercritical water may function to steam reform hydrocarbons, thereby producing hydrogen, carbon monoxide, carbon dioxide hydrocarbons, and water. This process is a major source for the generation of hydrogen in hydrothermal reactor 110, thereby eliminating the need to supply external hydrogen to the reactor. Thus, in one preferred embodiment, the step of contacting the petroleum feedstock and supercritical water is done in the absence of an external source of hydrogen, and optionally also in the absence of an externally supplied catalyst. Cracking of hydrocarbons present in the petroleum feedstock produces smaller hydrocarbon molecules, including but not limited to, methane, ethane and propane.

Hydrothermal reactor 110 produces first product stream 112 that includes lighter hydrocarbons than the hydrocarbons present in petroleum feedstock 102, preferably, methane, ethane and propane, as well as water. As noted previously, lighter hydrocarbons refers to hydrocarbons that have been cracked, thereby resulting in molecules that have a lower boiling point than the heavier hydrocarbons originally present in the petroleum feed 102.

First product stream 112 can then be supplied to adsorptive reaction stage 132 for further processing. In certain embodiments, adsorptive reaction stage 132 can be a tubular type reactor, a vessel type reactor, optionally including a stirrer, or other vessel known in the art. Alternatively, adsorptive reaction stage 132 can be a horizontal reactor, a vertical reactor, or a combined reactor having horizontal and vertical reaction zones. Adsorptive reaction stage 132 includes a reaction zone within the reaction vessel.

In some embodiments, adsorptive reaction stage 132 can optionally include a heater. In certain embodiments, adsorptive reaction stage 132 can include a heat exchanger operable to reduce temperatures within the reaction chamber. In certain embodiments, adsorptive reaction stage 132 can include a heat exchanger, wherein said heat exchanger is operable to remove heat from the reaction zone of adsorptive reaction stage 132 and provide heat to petroleum feed 102 and/or water feed 104.

Adsorptive reaction stage 132 is maintained at a subcritical temperature (i.e., a temperature that is less than about 374° C.). In certain embodiments, adsorptive reaction stage 132 is maintained at a temperature from about 50° C. to 350° C., optionally between about 100° C. to 300° C., or optionally between about 120° C. to 200° C. In alternate embodiments, adsorptive reaction stage 132 is maintained at a temperature such that water is maintained in a liquid phase.

In certain preferred embodiments, adsorptive reaction stage 132 is operated without the need for an external heat supply. In certain embodiments, first product stream 112 is supplied directly to post-treatment device 132 without first cooling or depressurizing the stream. Alternatively, first product stream 112 can be cooled prior to being supplied to adsorptive reaction stage 132, such as with a heat exchanger. In certain embodiments, petroleum feedstock 102 and/or water feed 104 can be heated in said heat exchanger.

In certain embodiments, first product stream 112 can be supplied to adsorptive reaction stage 132 without first separating the mixture, such that the first product stream includes water. In these embodiments, adsorptive reaction stage 132 can include a water-resistant catalyst, which preferably deactivates relatively slowly upon exposure to water. In certain embodiments, first product stream 112 can maintain sufficient heat for the reaction in adsorptive reaction stage 132 to proceed. Preferably, sufficient heat is maintained in first product stream 112 such that water is less likely to adsorb to the surface of the catalyst in adsorptive reaction stage 132.

In certain embodiments, the pressure in adsorptive reaction stage 132 is less than or equal to the pressure within hydrothermal reactor 110. In certain preferred embodiments, the pressure within adsorptive reaction stage 132 is less than the pressure within hydrothermal reactor 110. Preferably, the pressure within adsorptive reaction stage 132 is less than the pressure within hydrothermal reactor 110, and greater than the vapor pressure of water at the temperature of the adsorptive reaction stage.

In certain embodiments, because the operating temperature of adsorptive reaction stage 132 is maintained at a temperature that is lower than the critical temperature of water (i.e., the water is not in a supercritical state), a heterogeneous catalyst can be employed. Frequently, heterogeneous catalysts are not stable in the presence of supercritical water.

While many of the impurities that are present in petroleum feedstock 102 are decomposed in hydrothermal reactor 110, first product stream 112 typically includes significant amounts of impurities. In certain embodiments of the present invention, the amount of impurities that remain in first product stream 112 is the result of operating hydrothermal reactor 110 at less severe conditions (i.e., at temperatures and pressures that are lower than are typically employed for the upgrading of a petroleum feedstock with supercritical water). In certain embodiments, larger molecules in petroleum feedstock 102 are cracked within hydrothermal reactor 110, to produce cracked hydrocarbons, which can include impurities, for example sulfur, nitrogen, or metals. These impurities can be removed by the adsorptive reaction stage 132 by adsorptive and/or catalytic function.

In certain embodiments, adsorptive reaction stage 132 does not include a catalyst. In such embodiments wherein adsorptive reaction stage 132 lacks a catalyst, removal of impurities from first product stream 112 is achieved by thermal means. Generally, the removal of impurities from a petroleum stream utilizing thermal means is less effective than removal of impurities utilizing a catalyst.

Typically, decomposition of light in adsorptive reaction stage 132 results in the production of hydrogen sulfide and olefins. As used herein, light thiols refers to thiol compounds having between one and eight carbon atoms. Hydrogen sulfide can be dissolved in the hydrocarbon product stream from the adsorption reactive stage 132. In embodiments wherein adsorptive reaction stage 132 includes a catalyst, hydrogen sulfide can be adsorbed to the catalyst.

An added advantage to the use of adsorptive reaction stage 132 is that water/hydrocarbon emulsions can be destabilized. Similarly, surface active species, which can stabilize emulsions, can be destabilized by catalyst present in adsorptive reaction stage 132.

In other embodiments, adsorptive reaction stage 132 is a reactor that includes a solid adsorbent, and which does not require an external supply of hydrogen gas. In other embodiments, adsorptive reaction stage 132 is a hydrothermal reactor that includes the post-treatment solid adsorbent and an inlet for introducing of hydrogen gas. In alternate embodiments, adsorptive reaction stage 132 includes an adsorbent suitable for desulfurization, denitrogenation and/or demetalization of hydrocarbons present in first product stream. In certain other embodiments, adsorptive reaction stage 132 is operated without an external supply of hydrogen or other gas.

In prior art embodiments, post-reactor processes required that the feed to the process does not include water. Thus, prior art processes for post treatment of a product stream from a hydrothermal reactor utilizing supercritical water typically include an oil-water separation unit to remove water prior to feeding the product stream to the post-processing procedure. Frequently, in prior art processes that include a water separation step, a demulsifier may be required to achieve proper separation of water from the hydrocarbon product stream. Including catalysts in supercritical processes frequently leads to disintegration and decomposition of the catalyst. Similarly with adsorptive reaction stage 132, exposing the solid adsorbent contained therein to water at supercritical conditions leads to disintegration and decomposition.

In certain embodiments, the adsorptive reaction stage solid adsorbent may be suitable for desulfurization or demetalization. In certain embodiments, the adsorptive reaction stage solid adsorbent provides active sites on which sulfur and/or nitrogen containing compounds can be transformed into compounds that do not include sulfur or nitrogen, while at the same time liberating sulfur as hydrogen sulfide and/or nitrogen as ammonia. In certain embodiments, the adsorbent reaction stage can be operated without a solid adsorbent. For example, light thiols can be supplied to the adsorbent reaction stage where, by thermal effect, hydrogen sulfide and olefins are produced.

The adsorptive reaction stage solid adsorbent can include a support material and an active species. Optionally, the adsorptive reaction stage solid adsorbent can also include a promoter and/or a modifier. In certain embodiments, the adsorptive reaction stage solid adsorbent support material can include up to four members of the group consisting of aluminum oxide, silicon oxide, titanium oxide, magnesium oxide, yttrium oxide, lanthanum oxide, cerium oxide, zirconium oxide, activated carbon, or like materials, or combinations thereof. As used herein, metal oxides, for example silicon and titanium oxides, refers to all oxides of the metal, including non-stoichiometric oxides, for example $SiO_x$ and $TiO_x$, wherein x is between 1 and 2, inclusive, such as, for example, x=1, 1.8 or 2. The adsorptive reaction stage solid adsorbent active species includes between 1 and 4 of the metals selected from the group consisting of the Group IB, Group IIB, Group IVB, Group VB, Group VIB, Group VIIB and Group VIIIB metals of the periodic table. In certain preferred embodiments, the adsorptive reaction stage solid adsorbent active species is selected from the group consisting of cobalt, molybdenum and nickel. The optional promoter of the adsorptive reaction stage solid adsorbent can be selected from between 1 and 4 of the elements selected from the group consisting of the Group IA, Group IIA, Group IIIA and Group VA elements of the periodic table. Exemplary post-treatment solid adsorbent promoter elements include boron and phosphorous. The optional modifier of the adsorptive reaction stage solid adsorbent can include between 1 and 4 elements selected from the group consisting of the Group VIA and Group VIIA elements of the periodic table. The overall shape of the adsorptive reaction stage solid adsorbent, including the support material and active species, as well as any optional promoter or modifier elements, can be selected from pellet shaped, spherical, extrudate, flake, fabric, honeycomb or the like, and combinations thereof.

In preferred embodiments, adsorptive reaction stage 132 can include parallel reactors, such that one reactor is in use while solid adsorbent in the other reactor is being regenerated. Regeneration of the solid adsorbent can be achieved by heating the adsorptive reactor while streaming gas through the solid adsorbent bed, wherein preferred gases include oxygen or oxygen containing an alternate gas, such as nitrogen or other inert gas. Regeneration occurs at temperatures between about 100° C. and 500° C.

The product of adsorptive reaction stage 132 can be an upgraded petroleum stream 134 having a reduced content of at least one of sulfur containing species, nitrogen containing species, or metal containing species. In certain embodiments, upgraded petroleum stream 134 can be supplied to cooling device 136 to produce cooled upgraded petroleum stream 138. Cooling device 136 can be a chiller, heat exchanger, like device, or combination thereof. In certain preferred embodiments, cooling device 136 is a heat exchanger. In certain embodiments wherein cooling device 136 is a heat exchanger, upgraded petroleum stream 134 can be heat exchanged with petroleum feedstock 102 or water feed 104, or heated petroleum feedstock or heated water feed.

In certain embodiments, upgraded petroleum stream 138 is cooled to a temperature of less than about 250° C., alternatively less than about 200° C., alternatively less than about 150° C., or alternatively less than about 100° C. In certain embodiments, upgraded petroleum stream 138 is cooled to a temperature of between about 5° C. and 150° C., alternatively between about 10° C. and about 100° C. In certain preferred embodiments, upgraded petroleum stream 138 is cooled to a temperature of between about 25° C. and about 75° C.

In certain embodiments, upgraded petroleum stream 138 is depressurized following the exit of the stream from adsorptive reaction stage 132. Depressurizing can be achieved with a pressure regulating valve, a capillary tube, or other means known in the art. In certain embodiments, the pressure of upgraded petroleum stream 138 is reduced to between about 0.1 MPa and about 0.5 MPa. Alternatively, the pressure of upgraded petroleum stream 138 is reduced to between about 0.01 MPa and about 0.2 MPa.

Upgraded petroleum stream 138, which includes water and which can optionally be at a reduced pressure, can be supplied to gas-liquid separator 150 and separated into liquid phase stream 152 and gas phase stream 154. In certain embodiments, liquid phase stream 152 can be supplied to oil-water separator 160 and further separated into upgraded petroleum product stream 162 and water stream 164.

In certain embodiments, the hydrothermal reactor utilized in the present invention has at least one of a smaller volume, lower operating temperatures, and lower operating pressures, relative to prior art hydrothermal reactors utilizing supercritical water. In certain preferred embodiments, the hydrothermal reactor utilized in the present invention has a smaller volume, lower operating temperatures, and lower operating pressures, relative to prior art hydrothermal reactors utilizing supercritical water.

In certain embodiments wherein the hydrothermal reactor is operated at conditions that are at or just above supercritical conditions for water, it is possible to reduce the operating costs and fabrication costs for the hydrothermal reactor. Operating conditions that are just above supercritical conditions for water include temperatures between about 374° C. and about 450° C., preferably between about 374° C. and about 425° C., and at pressures between about 22.07 MPa and about 25 MPa, preferably between about 22.07 MPa and about 24 MPa. At these temperatures and pressures, the hydrothermal reactor can be constructed with stainless steel 316, instead of Inconel 625, which is normally required for operating at what are considered "harsh" conditions. The ability to use stainless steel 316, instead of Inconel 625, can reduce the capital expense of the reactor by about 30%.

By incorporating the adsorptive reaction stage into the process, the required residence time of the petroleum feedstock in the hydrothermal reactor is significantly reduced. For example, in certain embodiments, the required residence time in the hydrothermal reactor may be approximately 60 minutes, however, by incorporating the adsorptive reaction stage, the required residence time can be reduced to about 10 minutes.

In certain embodiments, adsorptive reaction stage 132 can be configured and operated to specifically remove mercaptans, thiols, thioethers, and other organo-sulfur compounds that may form as a result of recombination reactions of hydrogen sulfide (which is released during desulfurization of the petroleum feedstock by reaction with the supercritical water) and olefins and diolefins (which is produced during cracking of the petroleum feedstock by reaction with the supercritical water), which frequently occur in the hydrothermal reactor. The removal of the newly formed sulfur compounds from the recombination reaction may be through the dissociation of carbon-sulfur bonds, with the aid of catalyst, and in certain embodiments, water (subcritical water). In embodiments wherein the post treatment device is configured to remove sulfur from first product stream 112 and adsorptive reaction stage 132 is positioned subsequent to hydrothermal reactor 110, at least a portion of the lighter sulfur compounds, such as hydrogen sulfide, can be removed, thereby extending the operable lifetime of the post treatment catalyst.

The temperature in adsorptive reaction stage 132 can be maintained with an insulator, heating device, heat exchanger, or combination thereof. In embodiments employing an insulator, the insulator can be selected from plastic foam, fiber glass block, fiber glass fabric and others known in the art. The heating device can be selected from strip heater, immersion heater, tubular furnace, and others known in the art. In certain embodiments a heat exchanger can be employed and used in combination with a pressurized petroleum feedstock 102, pressurized water 104, pressurized and heated petroleum feedstock, or pressurized and heated petroleum water, such that cooled treated stream 130 is produced and supplied to post treatment device 132.

In certain embodiments, the residence time of first product stream 112 in adsorptive reaction stage 132 can between about 1 second and 90 minutes, optionally between about 1 minutes and 60 minutes, or optionally between about 2 minutes and 30 minutes. Adsorptive reaction stage 132 can be operated as a steady-state process, or alternatively can be operated as a batch process. In certain embodiments wherein adsorptive reaction stage 132 is operated as a batch process, two or more adsorptive reaction stages can be employed in parallel, thereby allowing the process to run continuously.

Adsorptive reaction stage 132 produces trimmed product stream 134 that can include hydrocarbons, water, and a reduced content of at least one of sulfur, sulfur containing compounds, nitrogen containing compounds, metals and metal containing compounds, which were removed by adsorptive reaction stage 132. In other embodiments, trimmed product stream 134 has a greater concentration of light hydrocarbons (i.e., adsorptive reaction stage 132 is operable to crack at least a portion of the heavy hydrocarbons present in product stream 112). Trimmed product stream 134 can optionally be supplied to cooling device 136, which can be a heat exchanger or chiller, to produce a cooled trimmed product stream 138, having a reduced temperature compared with trimmed product stream 134.

Trimmed product stream 134 can be supplied to depressurizer 140, which serves to reduce the pressure of the trimmed product stream and produce a depressurized trimmed product stream 142. Exemplary devices for depressurizing the product lines can be selected from a pressure regulating valve, capillary tube, or like device, as known in the art. In certain embodiments, the depressurized first product stream can have a pressure of between about 0.1 MPa and 0.5 MPa, optionally between about 0.1 MPa to 0.2 MPa. Depressurized trimmed product stream 142 can be supplied to gas-liquid separator 150 to produce gas phase stream 154, which can include one or more of methane, ethane, ethylene, propane, propylene, carbon monoxide, hydrogen, carbon dioxide, and hydrogen sulfide, and liquid phase stream 152, which includes water and upgraded hydrocarbons.

In certain embodiments, prior to supplying first product stream 112 to adsorptive reaction stage 132, the first product stream can be supplied to cooling means 123 to produce cooled first product stream 113. Exemplary cooling devices can be selected from a chiller, heat exchanger, or other like device known in the art. In certain preferred embodiments, cooling device 123 can be a heat exchanger, wherein first product stream 112 and either the petroleum feedstock, pressurized petroleum feedstock, water feed, pressurized water feed, pressurized and heated petroleum feedstock or pressurized and heated petroleum water can be supplied to the heat exchanger such that the treated stream is cooled and the petroleum feedstock, pressurized petroleum feedstock, water feed, pressurized water feed, pressurized, heated petroleum feedstock, or pressurized and heated petroleum water is heated. In certain embodiments, the temperature of cooled first product stream 130 is between about 5° C. and 150° C., optionally between about 10° C. and 100° C., or optionally between about 25° C. and 70° C. In certain embodiments, heat exchanger 114 can be used to in the heating of the feed petroleum and water streams 102 and/or 104, respectively, and the cooling of the first product stream 112.

Liquid-phase stream 152 can be supplied to oil-water separator 160 to produce upgraded petroleum stream 162 and water stream 164. In certain embodiments, water stream 164 can be recycled and combined with water feed 104.

As noted herein, one main advantage of the present invention and the inclusion of adsorptive reaction stage 132 is that the overall size of hydrothermal reactor 110 can be reduced. This is due, in part, to the fact that a large portion of the removal of the sulfur containing species can be achieved with adsorptive reaction stage 132, thereby reducing the residence time of the petroleum feedstock and supercritical water in hydrothermal reactor 110. Additionally, the use of adsorptive reaction stage 132 eliminates the need to operate hydrothermal reactor 110 at temperatures and pressures that are significantly greater than the critical point of water.

Example 1

Whole range Arabian Heavy crude oil and deionized water were pressurized to a pressure of about 25 MPa utilizing separate pump. The volumetric flow rates of crude oil and water, standard conditions, were about 0.29 and 0.62 mL/minute, respectively. The crude oil and water feeds were pre-heated using separate heating elements to temperatures of about 150° C. and about 450° C., respectively, and supplied to a mixing device that includes simple tee fitting. The combined crude oil and water feed stream was maintained in a hydrothermal reactor consisting of a tubing having an inner diameter of 10 mm and a length of 4 m at about 450° C. for a residence time of about 2.2 minutes. The hydrothermal reactor product stream was cooled with a chiller to produce a cooled product stream, having a temperature of approximately 60° C. The cooled product stream was depressurized by a back pressure regulator to atmospheric pressure. The cooled product stream was separated into gas, oil and water phase products. The total liquid yield of oil and water was about 93.8 wt. %. The product was in an emulsion and is subjected to centrifugation with a demulsifier. Table 1 shows representative properties of whole range Arabian Heavy crude oil and final product.

Example 2

Whole range Arabian Heavy crude oil and deionized water were pressurized with pumps to a pressure of about 25 MPa. The volumetric flow rates of the crude oil and water at standard condition were about 0.29 and 0.6 ml/minute, respectively. The petroleum and water streams were preheated using separate heaters, such that the crude oil had a temperature of about 150° C. and the water had a temperature of about 450° C., and were supplied to a combining device, which was a simple tee fitting, to produce a combined petroleum and water feed stream having a pre-reactor temperature of about 360° C. The combined petroleum and water feed stream was supplied to a hydrothermal reactor having an inner diameter of 10 mm and a length of 7.5 m where it is maintained at a temperature of about 450° C. for a residence time of about 4.1 minutes. A first product stream was removed from the hydrothermal reactor and cooled with a chiller to produce cooled first product stream, having a temperature of about 60° C. The cooled product stream was separated into gas, oil and water phase products. The total liquid yield of oil and water was about 93.8 wt. %. The product was in an emulsion and is subjected to centrifugation with a demulsifier. Table 1 shows representative properties of whole range Arabian Heavy crude oil and final product.

Example 3

Whole range Arabian Heavy crude oil and deionized water was pressurized to a pressure of about 25 MPa utilizing separate pump. The volumetric flow rates of crude oil and water, standard conditions, were about 0.29 and 0.62 mL/minute, respectively. The crude oil and water feeds were pre-heated using separate heating elements to temperatures of about 150° C. and about 450° C., respectively, and were supplied to a mixing device that includes simple tee fitting. The combined crude oil and water feed stream was maintained in a hydrothermal reactor consisting of a tubing having an inner diameter of 10 mm and a length of 4 m at about 450° C. for a residence time of about 2.2 minutes. The hydrothermal reactor product stream was cooled with a chiller to produce a cooled product stream, having a temperature of approximately 60° C. The cooled product stream was depressurized by a back pressure regulator to atmospheric pressure. The cooled product stream was separated into gas, oil and water phase products.

Approximately 50 mL of the liquid-phase stream was supplied to a batch reactor having a volume of 250 mL and to the liquid-phase stream was added approximately 2.5 g of a solid adsorbent that included molybdenum oxide on an activated carbon support. Helium was added to the batch reactor to a pressure of about 600 psig. The reaction mixture was stirred at about 500 rpm at a temperature of about 150° C. for about 30 minutes. The product of the reaction was separated into water and oil phases by centrifugation, without added demulsifier.

TABLE 1

Properties of Feedstock and Product

| | Total Sulfur | API Gravity | Distillation, T80 (° C.) |
|---|---|---|---|
| Whole Range Arabian Heavy | 3.05 wt % sulfur | 23.1 | 625 |
| Example 1 | 2.54 wt % sulfur | 28.9 | 560 |
| Example 2 | 2.52 wt % sulfur | 30.7 | 486 |
| Example 3 | 1.77 wt. % sulfur | 30.1 | 531 |

As shown in Table 1, the first and second processes, consisting of a hydrothermal reactor utilizing supercritical water, resulted in a decrease of total sulfur of about 17% by weight. In contrast, use of the adsorptive reaction stage, results in the removal of approximately an additional 25% by weight of the sulfur present, for an overall reduction of approximately 42% by weight. The adsorptive reaction stage also results in a slight increase of the API gravity and a slight decrease of the T80 distillation temperature, as compared with supercritical hydrotreatment alone. API Gravity is defined as (141.5/specific gravity at 60° F.)−131.5. Generally, the higher the API gravity, the lighter the hydrocarbon. The T80 distillation temperature is defined as the temperature where 80% of the oil is distilled.

Figure 2:
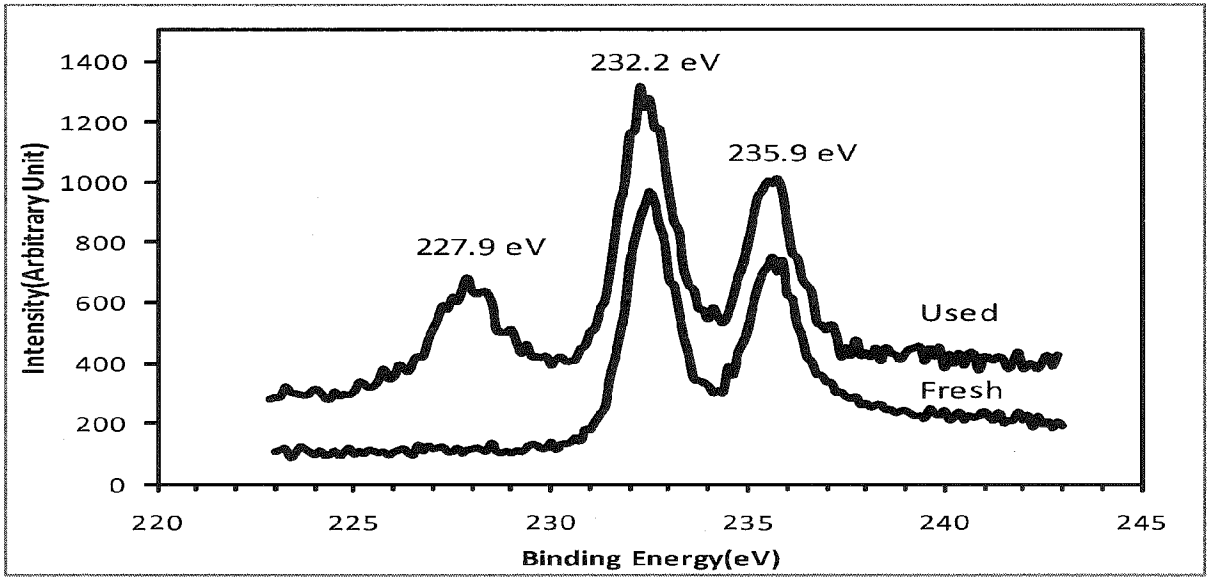
FIG. 2 provides an XPS spectra of the element molybdenum for a molybdenum solid adsorbent.
Figure 3:
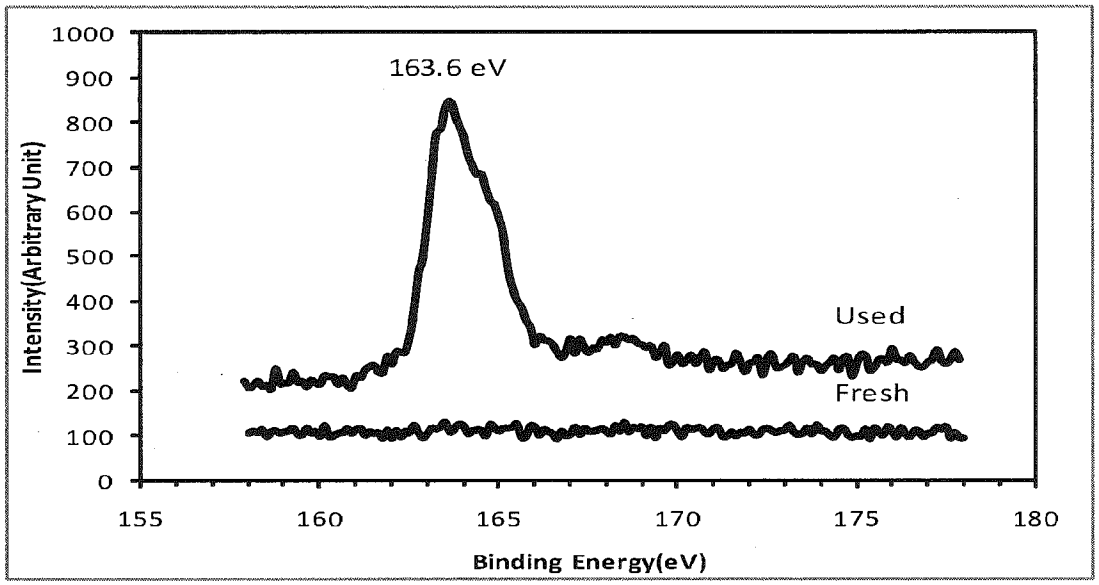
FIG. 3 provides an XPS spectra of the element sulfur for a molybdenum solid adsorbent.

As shown in FIGS. 2 and 3, XPS (x-ray photoelectron spectroscopy) provides information relating to the chemical state of elements molybdenum and sulfur in the reaction sample. As for FIG. 2, Molybdenum XPS is shown. The bottom trace shows the XPS spectra for a fresh sample of the molybdenum oxide solid adsorbent, and includes only two peaks at 232.2 eV and 235.9 eV, which can be assigned to molybdenum in $MoO_3$ compounds. In contrast, the XPS spectra of a spent adsorbent (top trace) shows an additional peak at 227.9 eV, corresponding to the presence of partially reduce molybdenum state. Referring to FIG. 3, the bottom trace shows the XPS spectra for a fresh sulfur sample, whereas the top trace shows the XPS spectra for a spent sample, showing a peak at 163.6 eV, which can be assigned to sulfur in sulfide state.

These observation indicates strong interaction of adsorbent and oil matrix resulted in change of molybdenum state and left sulfur on the adsorbent. Because adsorbent was thoroughly washed with methylene chloride before being subjected to XPS, presence of weakly binding sulfur on the adsorbent can be excluded.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these reference contradict the statements made herein.

That which is claimed is:

1. A method for upgrading a petroleum feedstock without supplying an external hydrogen gas supply, the method comprising the steps of:

supplying a petroleum feedstock to a mixer, where the step includes pumping the petroleum feedstock to a pressure greater than 22.06 MPa and heating the petroleum feedstock to a temperature of up to about 250° C. to produce a pressurized and heated petroleum feedstock, supplying a water feed to the mixer, where the step includes pumping the water feed to a pressure greater than 22.06 MPa and heating the water feed to a temperature of between about 250° C. and 650° C. to produce a pressurized and heated water feed;

combining the heated and pressurized petroleum feedstock and the heated and pressurized water feed in the mixer to produce a pressurized and heated combined stream;

supplying the pressurized and heated combined stream to a hydrothermal reactor, where the hydrothermal reactor is maintained at a temperature between about 350° C. and 550° C. and where the pressurized and heated combined stream is maintained in a reaction zone of the hydrothermal reactor for a hydrothermal residence time of between about 10 seconds and 20 minutes to produce a modified stream, where the modified stream comprises water, where the modified stream is a water/hydrocarbon emulsion;

supplying the modified stream to an adsorptive reaction stage charged with a heterogeneous catalyst to produce a trimmed stream, where the adsorptive reaction stage is maintained at a temperature between 120° C. and 200° C., and where the heterogeneous catalyst can destabilize the water/hydrocarbon emulsion, where the heterogeneous catalyst is operable to transform at least one impurity from the modified stream, where the at least one impurity is selected from the group consisting of sulfur, nitrogen, and a metal;

cooling and depressurizing the trimmed stream to produce a gas stream and a liquid stream; and separating the liquid stream to produce a water stream and an upgraded petroleum product stream.

2. The method of claim 1 where the petroleum feedstock and the water feed are supplied to the hydrothermal reactor at a ratio of volumetric flow rates of petroleum feedstock to water in a range of from about 1:10 to about 10:1.

3. The method of claim 1 where the hydrocarbon feedstock is selected from whole range crude oil, topped crude oil, liquefied coal, a product stream from a petroleum refinery, a product stream from a steam cracker, and a liquid product recovered from oil sand, bitumen or asphaltene.

4. The method of claim 1 where the heterogeneous catalyst includes an active material having 1 to 4 elements that are selected from the group consisting of elements of Groups IVB, VB, VIIB, VIIB, VIIIB, IB, and IIB of the Periodic Table of Elements.

5. The method of claim 1 where the heterogeneous catalyst includes a promoting material having 1 to 4 elements that are selected from the group consisting of elements of Groups IA, IIA, IIIA and VA of the Periodic Table of Elements.

6. The method of claim 1 where the heterogeneous catalyst includes a modifying material having 1 to 4 elements that are selected from the group consisting of elements of Groups VIA and VIIA of the Periodic Table of Elements.

7. The method of claim 1 where the heterogeneous catalyst includes a support material having 1 to 4 compounds that are selected from the group consisting of aluminum oxide, silicon oxide, titanium oxide, magnesium oxide, yttrium oxide, lanthanum oxide, cerium oxide, zirconium oxide, and activated carbon.

8. The method of claim 1 where the heterogeneous catalyst is operable to adsorb hydrogen sulfide.

9. The method of claim 1 where the heterogeneous catalyst is operable to destabilize surface active species.

10. The method of claim 1 where the heterogeneous catalyst is a water-resistant catalyst.

11. The method of claim 10 where the water-resistant catalyst is hydrophobic.

12. The method of claim 1 where the adsorptive reaction stage is maintained adiabatically.

13. The method of claim 1 where the adsorptive reaction stage is operable to remove mercaptans, thiols, thioethers, and other organo-sulfur compounds that form in the hydrothermal reactor as a result of a combination between hydrogen sulfide and olefins or diolefins.

14. The method of claim 1 where the upgraded petroleum product stream produced has one or more properties of a higher API gravity, a higher middle distillate yield, a lower content of sulfur containing compounds, a lower content of nitrogen compounds, or a lower content of metal containing compound comparatively to the supplied petroleum feedstock.

* * * * *